United States Patent [19]

Mai et al.

[11] Patent Number: 4,510,049

[45] Date of Patent: Apr. 9, 1985

[54] PROCESS FOR RECOVERY OF COLEMANITE AND PROBERTITE FROM MIXED LOW GRADE ORE

[75] Inventors: Anh Mai, Grand Rapids; Donald J. Kaczynski, Pengilly, both of Minn.; Lawrence W. Trainor, deceased, late of Portales, N. Mex., by Marie L. Trainor, executor

[73] Assignee: Owens-Corning Fiberglas Corporation, Toledo, Ohio

[21] Appl. No.: 535,521

[22] Filed: Sep. 26, 1983

[51] Int. Cl.[3] ..... B03B 1/00

[52] U.S. Cl. ..... 209/3; 209/166; 241/24

[58] Field of Search ..... 209/166, 167; 75/1 R; 241/24

[56] References Cited

U.S. PATENT DOCUMENTS

| | | | |
|---|---|---|---|
| 2,317,413 | 4/1943 | Shelton | 209/166 |
| 3,635,338 | 1/1972 | Chemtob et al. | 209/166 |
| 3,768,738 | 10/1973 | Sawyer et al. | 209/166 |
| 4,441,993 | 4/1984 | Howald | 209/167 |

OTHER PUBLICATIONS

Aero 845-Promotor Am. Cyanamid, Am. Cyanamid Co., Wayne, N.J., 5/79.

*Primary Examiner*—Bernard Nozick

*Attorney, Agent, or Firm*—Ronald C. Hudgens; Patrick P. Pacella; Philip R. Cloutier

[57] ABSTRACT

A method of producing concentrates of colemanite and probertite from mixed low grade ore which involves desliming at different particle sizes for colemanite and probertite recovery.

7 Claims, 1 Drawing Figure

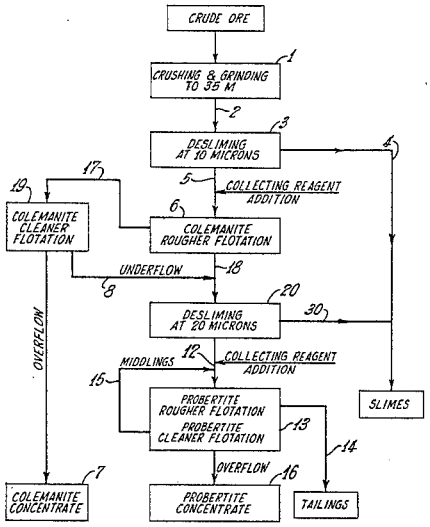

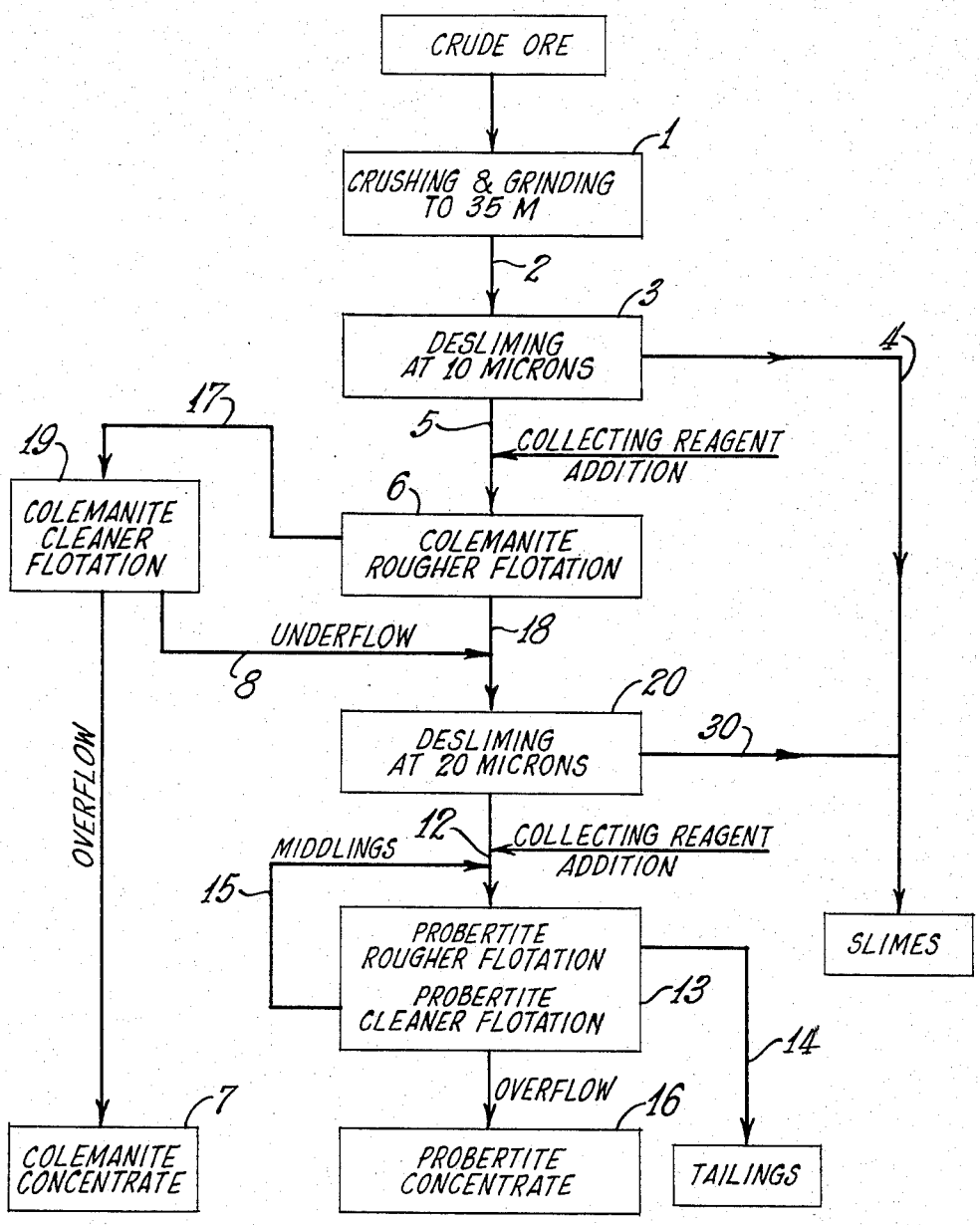
CRUDE ORE
CRUSHING & GRINDING TO 35 M
1
2
DESLIMING AT 10 MICRONS
3
4
5
COLLECTING REAGENT ADDITION
17
19
COLEMANITE CLEANER FLOTATION
6
COLEMANITE ROUGHER FLOTATION
UNDERFLOW
18
8
20
DESLIMING AT 20 MICRONS
30
OVERFLOW
12
MIDDLINGS
COLLECTING REAGENT ADDITION
15
PROBERTITE ROUGHER FLOTATION
PROBERTITE CLEANER FLOTATION
13
SLIMES
14
OVERFLOW
16
7
COLEMANITE CONCENTRATE
PROBERTITE CONCENTRATE
TAILINGS

PROCESS FOR RECOVERY OF COLEMANITE AND PROBERTITE FROM MIXED LOW GRADE ORE

This invention relates to a process for recovering concentrates of colemanite and probertite from mixed low grade core.

In one of its more specific aspects, this invention relates to the recovery of colemanite and probertite, by differential flotation, from a mixed crude ore, in the form of high grade borate concentrates.

The existance of crude ores containing colemanite and probertite is well known. While the colemanite and probertite are important from the standpoint of their $B_2O_3$ values, processes for recovering these minerals as individual high grade concentrates from mixed crude ore have not been particularly effective. This invention provides a method of doing so.

STATEMENT OF THE INVENTION

According to the invention, there is provided a method of producing concentrates of colemanite and probertite from mixed low grade crude ore which comprises crushing and grinding the ore to 35 mesh maximum, desliming the ground ore at about 10 microns, and recovering a combined fraction, separating the combined fraction to a colemanite-rich concentrate and a probertite-rich concentrate, desliming the probertite-rich concentrate at about 14 to about 20 microns and individually floating the probertite-rich concentrate and the colemanite-rich concentrate to produce a probertite concentrate and a colemanite concentrate.

BRIEF DESCRIPTION OF THE DRAWING

The attached drawing is a schematic flow diagram of the process.

DETAILED DESCRIPTION

The method of this invention is applicable to any colemanite-containing and probertite-containing ore. It is particularly applicable to a mixed crude ore.

Referrring to the attached drawing, the crude ore is subjected to a size reduction step 1 to reduce the ore to about 35 mesh, maximum. Any suitable size reduction process can be employed. Preferably, a plurality of steps will be employed, the first being impact crushing and the second being wet ball milling, the combination being sufficient to attain the desired particle sizes.

The ground crude ore 2 is then introduced into a conventional desliming process 3. Any desliming process suitable for efficient removal of micron slimes, including hydrocycloning or elutration, can be employed. The desliming is conducted at approximately 10 microns and the slime 4 is withdrawn and a recovered fraction 5 is routed to flotation step 6.

Any suitable flotation process can be employed. Preferably, this flotation step, which separates a colemanite-rich fraction 17 and a probertite-rich fraction 18 will be followed by 3 cleaner stages step 19. Conventional collecting agents are introduced into the charge at the rougher flotation step 6.

Any suitable collecting agent can be employed. Such agents usually are anionic petroleum sulfonates, such as American Cyanamid's Aero Promoters 801, 825 and 845, these being employed individually, or in combination, in an amount of about 2.3 pounds per ton of crude ore.

From the colemanite flotation 19, a colemanite concentrate 7 is recovered.

The rougher and cleaner tailing products 18 and 8 from the colemanite circuit are combined and subjected to desliming at 14 to 20 microns. The deslimed material 12 is then conditioned with about 0.8 pounds of the above-mentioned collecting agents per ton of crude ore.

The deslimed and conditioned material is routed to flotation step 13. Any suitable flotation process 13 can be employed. Preferably, this flotation step which recovers the probertite-rich fraction will consist of one rougher stage and 3 cleaner stages. The rougher tailings 14 are discharged as final reject while the cleaner cell underflow products 15 can be recirculated as middlings, the probertite concentrate being recovered as product stream 16.

Each of the concentrates can be reclaimed in any suitable manner, including filtering and drying.

EXAMPLE I

The following example demonstrates the benefits of carrying out this invention according to the method previously described.

A differential flotation process, as described above, was carried out to separate colemanite and probertite.

The feed was a mixed crude ore comprising colemanite and probertite in approximately a 3 to 1 mixture by weight with a boron grade of approximately 20% $B_2O_3$. The natural pH of the ore pulp was 8.9.

American Cyanamid's Aero Promotors 801 and 825 were employed in a 1 to 3 weight ratio as the collecting reagent, 2.3 pounds of the mixture per ton of crude ore being employed in the colemanite rougher flotation stage and 0.8 pound of the mixture per ton of crude ore being employed in the probertite rougher flotation stage. Results were as follows, when desliming the crushed ore at about 10 microns and the probertite-rich fraction at about 20 microns.

| Product | % Wgt | % $B_2O_3$ | % Na | % $B_2O_3$ Dist. |
|---|---|---|---|---|
| Colemanite Concentrate | 27.37 | 42.2 | 0.26 | 59.32 |
| Probertite Concentrate | 12.16 | 35.6 | 2.75 | 22.23 |
| Middlings | 10.30 | 10.2 | 1.21 | 5.37 |
| Tailings | 17.51 | 3.3 | 0.54 | 2.97 |
| Combined Slimes | 32.67 | 6.0 | 0.70 | 10.11 |
| Total (Feed) | 100.00 | 19.47 | 0.85 | 100.00 |

The above data demonstrate the efficiency of the process in concentrating the $B_2O_3$ values in the colemanite and probertite concentrates.

EXAMPLE II

The process described above was carried out on colemanite ore and probertite ore with the following results:

| Test No. | Nominal Particle Size of Slime Removed | Flotation Results: Conc. Grade (% $B_2O_3$) | Flotation Results: Boron Recovery (% $B_2O_3$ Units) |
|---|---|---|---|
| A - Colemanite Ore | | | |
| 5A | (No desliming) | No separation | |
| 5 | 10 microns | 41.2 | 76.3 |
| 67 | 14 microns | 43.0 | 75.6 |
| B - Probertite Ore | | | |
| 38 | (No desliming) | No separation | |

-continued

| Test No. | Nominal Particle Size of Slime Removed | Flotation Results: Conc. Grade (% $B_2O_3$) | Flotation Results: Boron Recovery (% $B_2O_3$ Units) |
|---|---|---|---|
| 3 | 10 microns | No separation | |
| 47 | 14 microns | 36.89 | 46.8 |
| 48 | 17 microns | 37.99 | 49.7 |
| 62 | 20 microns | 37.10 | 62.9 |

These data demonstrate that slime removal at 10 microns is preferred for colemanite flotation and that recovery of probertite requires a more intensive desliming, that is, material in the size range of 10 to 20 microns, nominal, must also be removed in order for the flotation process to yield an acceptable boron recovery.

It will be evident from the foregoing that various modifications can be made to the method of this invention. Such, however, are within the scope of the invention.

We claim:

1. A method of producing concentrates of colemanite and probertite from mixed low grade crude ore which comprises:

(a) crushing the ore;

(b) desliming the crushed ore at about 10 microns and recovering a combined product;

(c) floating the combined product to separate a colemanite-rich fraction and a probertite-rich fraction, removing the colemanite-rich fraction as an overflow stream and removing the probertite-rich fraction as an underflow stream, wherein said floatings are done in contact with a collecting agent, wherein said collecting agent is an anionic petroluem sulfonate or a mixture of anionic petroleum sulfonates.

(d) desliming the probertite-rich fraction at about 20 microns; and (e) individually floating the probertite-rich fraction and the colemanite-rich fraction to produce a probertite concentrate and a colemanite concentrate, and recovering the probertite concentrate as an overflow stream and recovering the colemanite concentrate as an overflow stream, wherein said floatings are done in contact with a collecting agent, wherein said collecting agent is an anionic petroleum sulfonate or a mixture of anionic petroleum sulfonates.

2. The method of claim 1 in which said ore is crushed to about 35 mesh, maximum.

3. The method of claim 1 in which said probertite fraction is deslimed at about 14 to about 20 microns.

4. The method of claim 1 in which colemanite-rich concentrate comprises about 27 weight percent of said ore.

5. The method of claim 4 in which said colemanite-rich concentrate comprises about 42 weight percent $B_2O_3$ and contains about 59 percent of the $B_2O_3$ units in said ore.

6. The method of claim 1 in which said probertite concentrate comprises about 12 weight percent of said ore.

7. The method of claim 6 in which said probertite-rich concentrate comprises about 35 weight percent $B_2O_3$ and contains about 22 percent of the $B_2O_3$ units in said ore.

* * * * *